US009939230B2

(12) United States Patent
Higgins et al.

(10) Patent No.: US 9,939,230 B2
(45) Date of Patent: Apr. 10, 2018

(54) PHYSICAL AIDE FOR IMPROVING TARGETING PROFICIENCY

(71) Applicants: John Higgins, Camden, SC (US); Rhonda Young, Camden, SC (US)

(72) Inventors: John Higgins, Camden, SC (US); Rhonda Young, Camden, SC (US)

( * ) Notice: Subject to any disclaimer, the term of this patent is extended or adjusted under 35 U.S.C. 154(b) by 367 days.

(21) Appl. No.: 14/713,763

(22) Filed: May 15, 2015

(65) Prior Publication Data

US 2016/0334192 A1 Nov. 17, 2016

(51) Int. Cl.
*F41A 33/00* (2006.01)
*F41G 3/26* (2006.01)

(52) U.S. Cl.
CPC ..... *F41G 3/26* (2013.01)

(58) Field of Classification Search
CPC ..... F41J 1/01; F41J 9/16
USPC ..... 434/11, 16, 19; 273/362, 363, 365, 378, 273/380
See application file for complete search history.

(56) References Cited

U.S. PATENT DOCUMENTS 4,433,842 A * 2/1984 Bertini ..... F41J 9/16 273/363
4,961,585 A * 10/1990 Crawford ..... F41J 9/165 273/363
5,389,142 A * 2/1995 Moore ..... C04B 28/26 106/205.9
5,397,132 A * 3/1995 Maryska ..... F41J 1/01 273/363
5,716,216 A * 2/1998 O'Loughlin ..... F41A 33/02 273/365
5,915,695 A * 6/1999 Wisocki ..... F41J 1/01 273/362
9,568,287 B2 * 2/2017 Nienke ..... F41J 1/01
2014/0284879 A1 * 9/2014 Hendrix ..... F41J 1/10 273/407
2015/0136101 A1 * 5/2015 Jensen ..... F41J 9/28 124/5
2015/0137453 A1 * 5/2015 Taylor ..... F41J 1/01 273/362

* cited by examiner

*Primary Examiner* — Kurt Fernstrom
(74) *Attorney, Agent, or Firm* — Dunlap Bennett & Ludwig PLLC

(57) ABSTRACT

A teaching device for training shooters to choose the best place to shoot a clay target is provided, whereby the teaching device greatly simplifies the decision making process and increases the students' awareness of target lines, directions and break zones. The teaching device may include a plurality of pointers rotatably connected to a clock face by a pivot fastener. The teaching device may include a target holder centrally disposed along the clock face, wherein the target holder is understood to represent a clay target. The plurality of pointers may independently rotate relative to each other so that each pointer may be positioned at a different relationship to the target holder so as to physically represent different choices, predictions and outcomes regarding the targeting thereof, including chosen target lines, predicted break lines and the outcomes of their chosen target lines.

7 Claims, 4 Drawing Sheets

PHYSICAL AIDE FOR IMPROVING TARGETING PROFICIENCY

BACKGROUND OF THE INVENTION

The present invention relates to methods and apparatus for training in the use of an optically aimed weapon and, more particularly, to a device for training shooters to choose the best place to shoot a clay target.

Proficiency with a weapon, e.g., rifle, shotgun, pistol or revolver, requires practicing how to properly aim and accurately shoot the weapon at a target. Moreover, properly choosing what portion of the target—the target line—is also a major component of obtaining proficiency with the weapon. This is particularly true in the sport of clay target shooting, where it can be difficult to determine the best place to shoot at the clay target. One major problem is students' lack of awareness of target lines, directions and break zones, especially because they have no physical representation to help them understand.

As can be seen, there is a need for a device for training shooters to choose the best place to shoot a clay target, whereby the device greatly simplifies the decision making process and increases the students' awareness of target lines, directions and break zones.

SUMMARY OF THE INVENTION

In one aspect of the present invention, teaching device for training shooters to choose the best place to shoot a clay target includes a clock face forming a centrally disposed pivot opening; a plurality of pointers, each forming a pointer pivot opening; a pivot fastener adapted to be received by the plurality of pivot openings so that the plurality of pointers are rotatably connected to the clock face about the pivot fastener; and a target holder centrally disposed on the pivot fastener.

In another aspect of the present invention, a teaching device for training shooters to choose the best place to shoot a clay target includes a clock face forming a centrally disposed pivot opening; a plurality of pointers, each forming a pointer pivot opening, wherein each pointer pivot opening is generally centrally disposed within its respective pointer; a pivot fastener adapted to be received by the plurality of pivot openings so that the plurality of pointers are rotatably connected to the clock face about the pivot fastener, wherein the pivot holder has: a target holder formed on the pivot fastener; and a plurality of deformable legs perpendicularly extending from the target holder and through the plurality of pivot openings; an adhesive securing the plurality of deformable legs to a back face of the clock face; and a plurality of sequential numbers along and inward from a periphery of the clock face.

In yet another aspect of the present invention, a method of training shooters to choose the best place to shoot a real clay target includes providing a teaching device having a plurality of pointers rotatably connected to a clock face by a pivot fastener about which each pointer can independently rotate, and wherein a target holder is disposed on the pivot fastener so as to represent a clay target; positioning a first pointer along the clock face corresponding to the shooter's choice of a target line relative to the represented clay target; positioning a second pointer along the clock face corresponding to the shooter's prediction of a break line relative to the represented clay target; shooting at the real clay target; and positioning a third pointer along the clock face corresponding to the shooting's actual hit location on the real clay target.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a teaching device for training shooters to choose the best place to shoot a clay target, whereby the teaching device greatly simplifies the decision making process and increases the students' awareness of target lines, directions and break zones. The teaching device may include a plurality of pointers rotatably connected to a clock face by a pivot fastener. The teaching device may include a target holder centrally disposed along the clock face, wherein the target holder is understood to represent a clay target. The plurality of pointers may independently rotate relative to each other so that each pointer may be positioned at a different relationship to the target holder so as to physically represent different choices, predictions and outcomes regarding the targeting thereof, including chosen target lines, predicted break lines and the outcomes of their chosen target lines.

Figure 1:
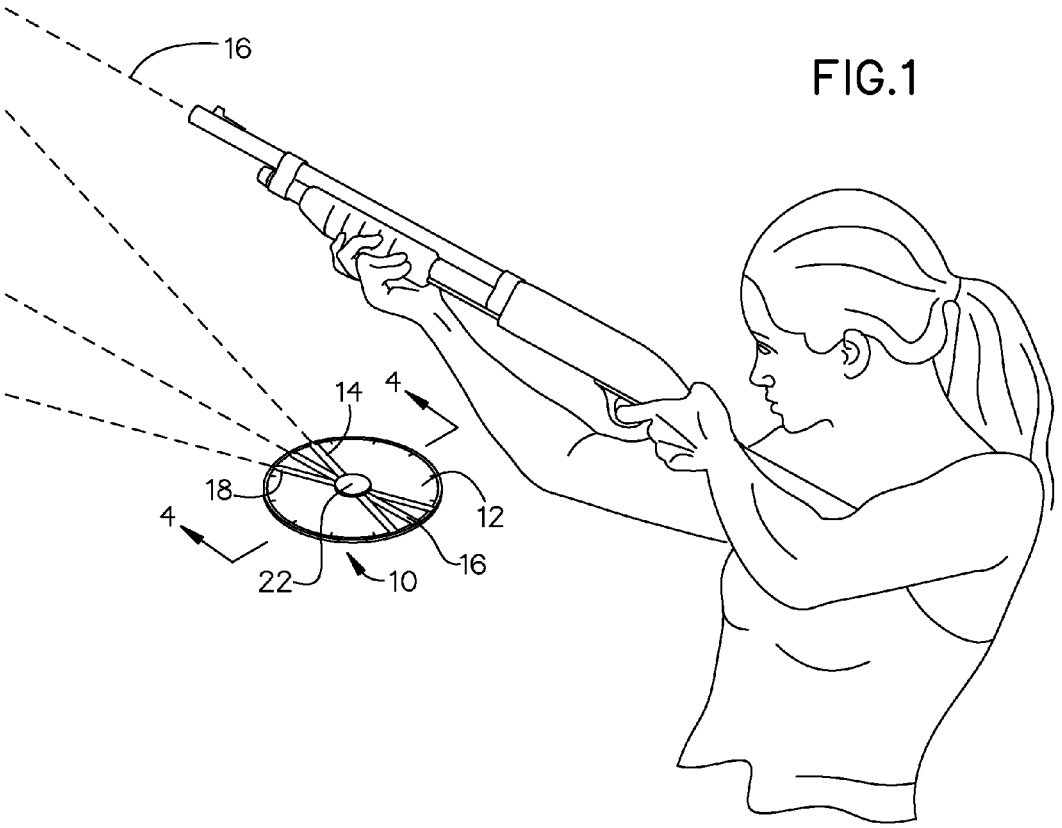
FIG. 1 is a perspective schematic view of an exemplary embodiment of the present invention, shown in use.
Figure 2:
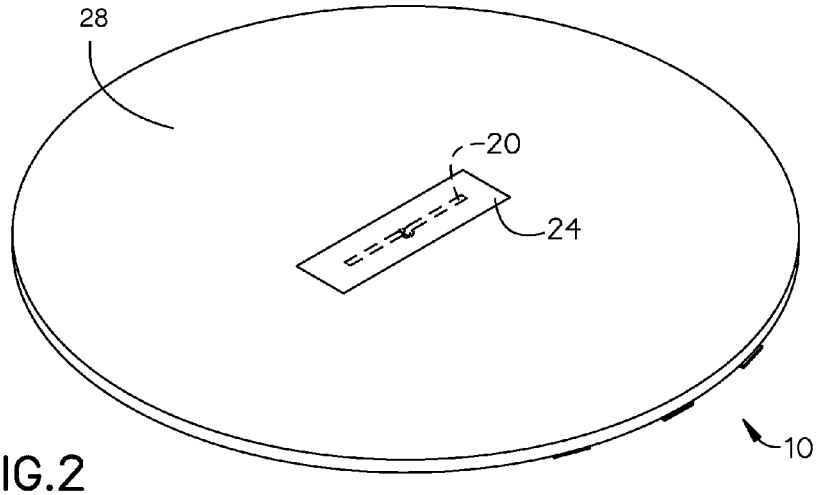
FIG. 2 is a rear perspective view of an exemplary embodiment of the present invention.
Figure 3:
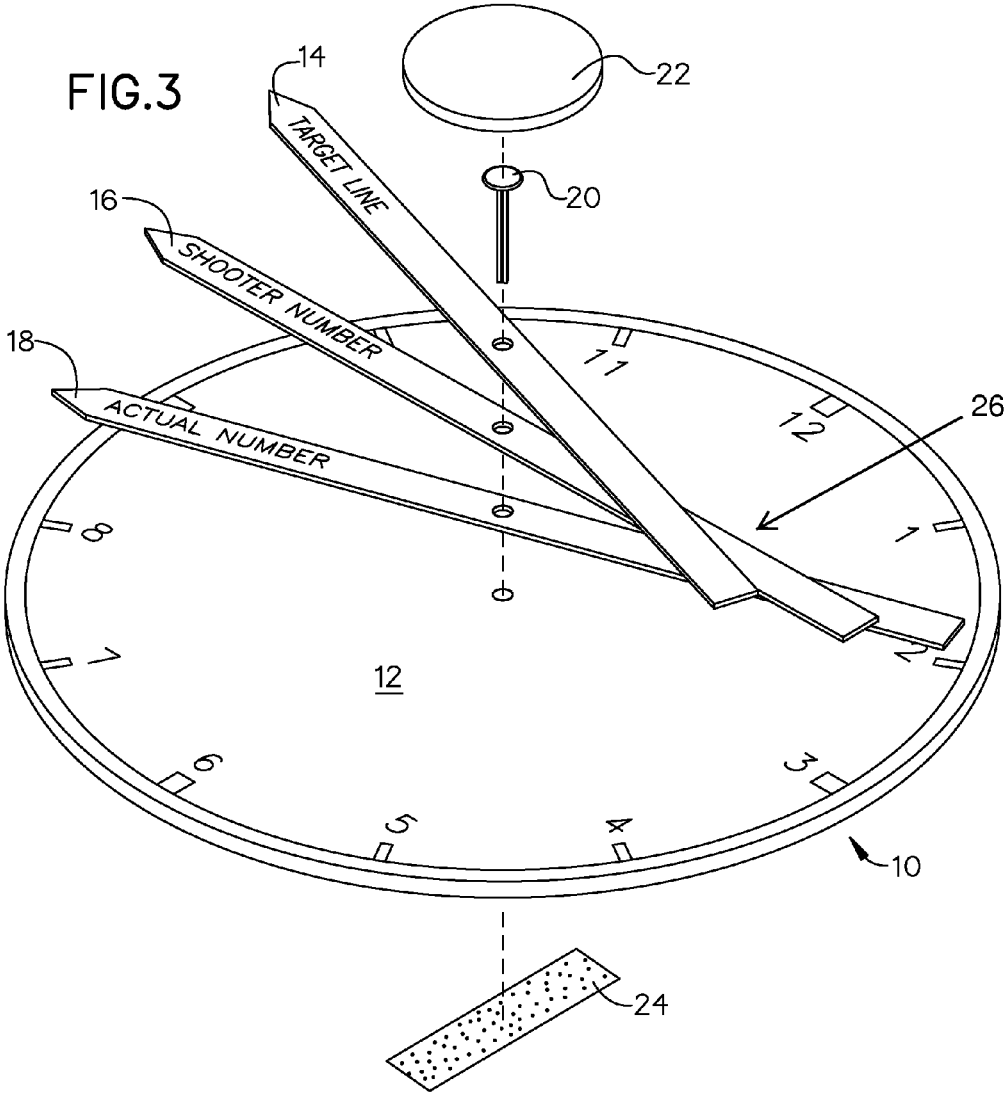
FIG. 3 is an exploded view of an exemplary embodiment of the present invention.
Figure 4:
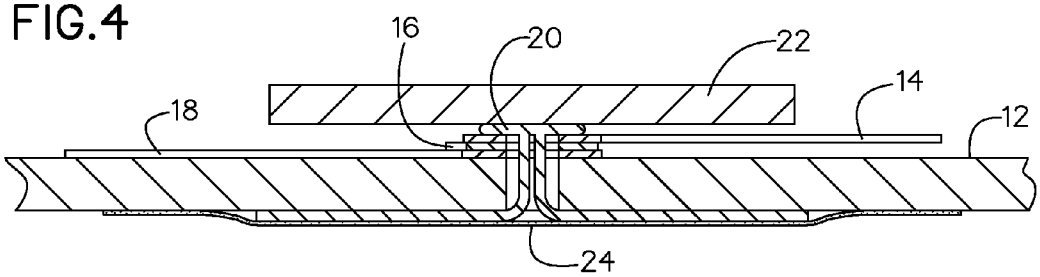
FIG. 4 is a section view of an exemplary embodiment of the present invention, taken along line 4-4 in FIG. 1.
Figure 5:
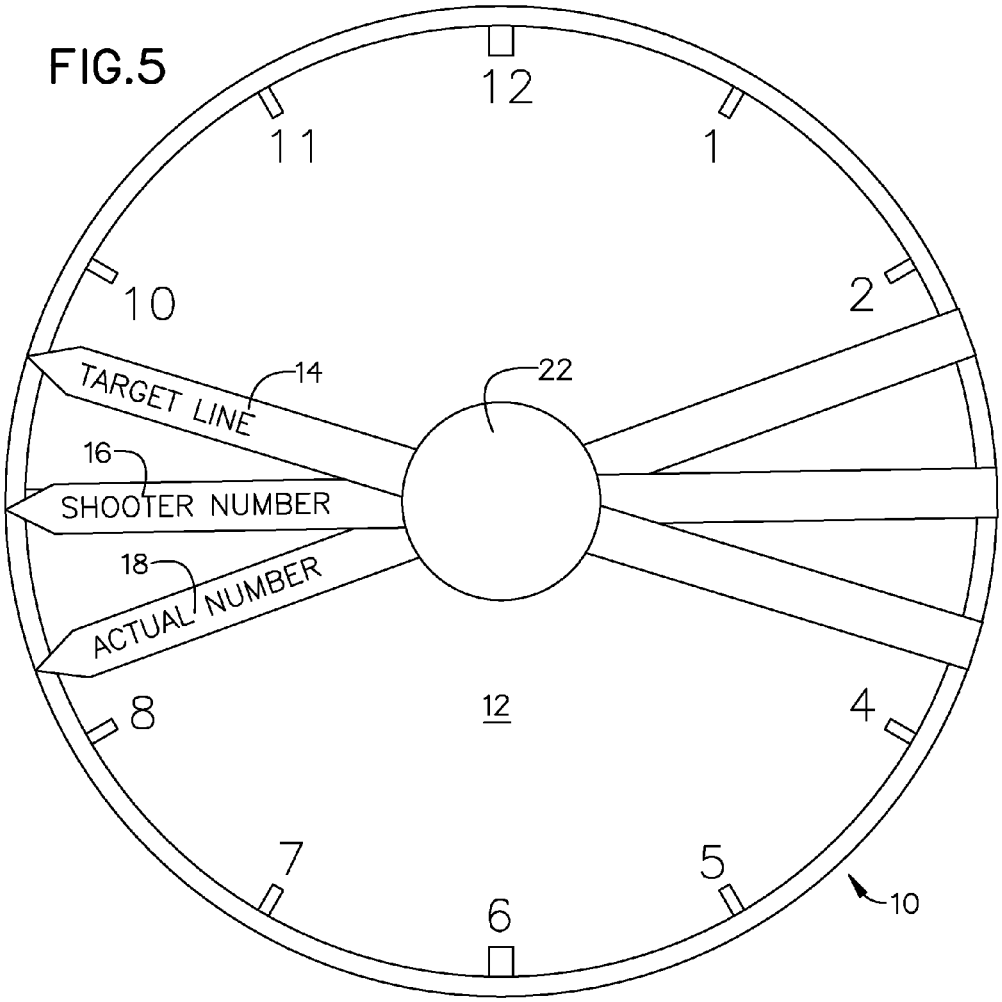
FIG. 5 is a top view of an exemplary embodiment of the present invention, shown in use.

Referring to FIGS. 1 through 6, the present invention may include a teaching device 10. The teaching device 10 may include a plurality of pointers 26 rotatably connected to a clock portion 28 by a pivot fastener 20. The clock portion 28 may be made of lightweight, resilient material such as cardboard. In certain embodiments the material may be waterproof. The clock portion 28 may be formed into a generally circular shape, though the clock portion 28 may be any geometric or non-geometric shape so long as the clock portion 28 functions in accordance with the present invention as described herein. The clock portion 28 may form a clock face 12 and a back face 30. A plurality of sequential numbers may be disposed near a peripheral edge of the clock face 12 so as to resemble traditional clock face, as illustrated in FIGS. 3 and 5.

Figure 6:
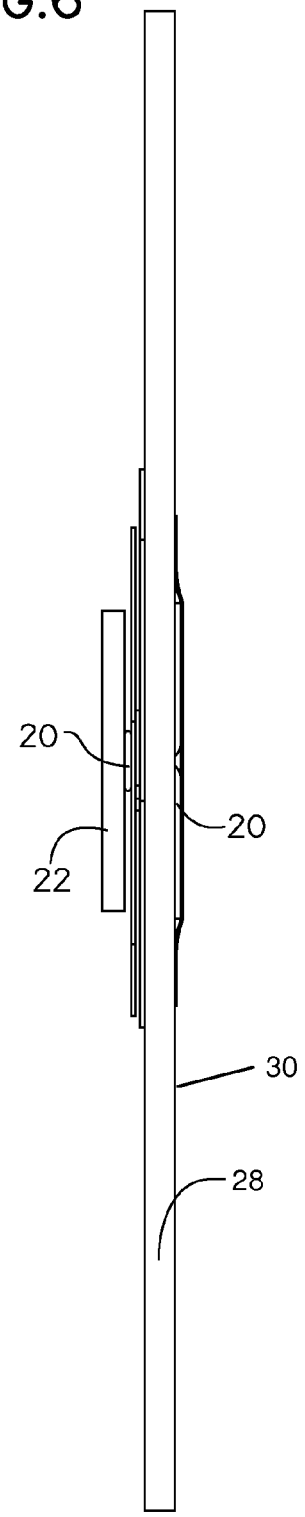
FIG. 6 is a side view of an exemplary embodiment of the present invention.

The clock portion 28 may form a centrally disposed pivot opening for receiving the pivot fastener 20. The pivot fastener 20 may be made of deformable material forming at least a plurality of leg portions extending perpendicularly from a head, wherein a portion of the leg portions may be bent so as to secure the pivot fastener 20 within the pivot opening, and wherein the unbent portion of the leg portion may act as the bearing about which the plurality of pointers rotate, as illustrated in FIGS. 3, 4 and 6. An adhesive 24 may be disposed along the back face 30 so as to secure at least one of the leg portions thereto, as illustrated in FIGS. 3, 4 and 6.

The plurality of pointers 26 may include a target line pointer 14, a shooter number pointer 16, and an actual number pointer 18. Each pointer 14, 16, and 18 may form their own pivot opening for receiving the pivot fastener so that each pointer 14, 16, and 18 may rotate about the pivot fastener 20 relative to each other. A target holder 22 may be centrally disposed on the head of the pivot fastener 20. The target holder 22 may be circular shaped to resemble a clay target. In certain embodiments, the holder 22 may be adapted to temporarily lock at least one of the plurality of pointers 26 into place.

Figure 7:
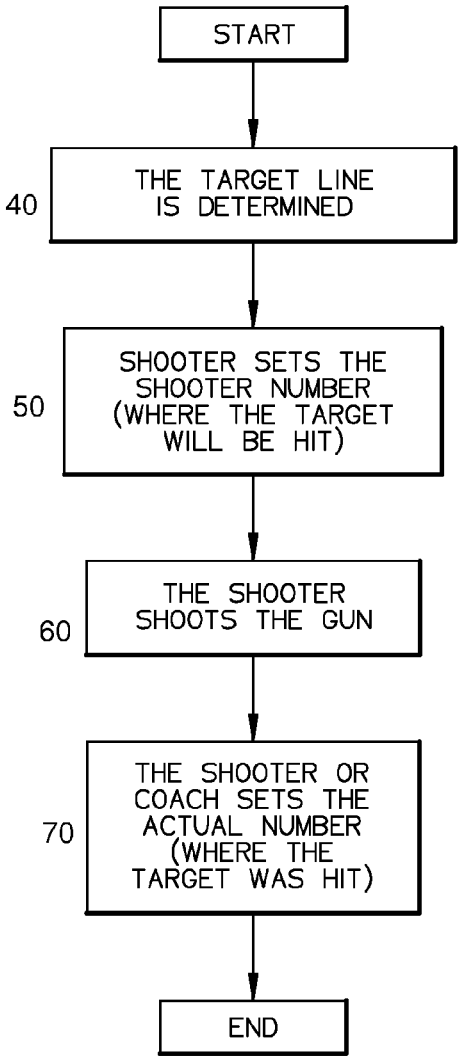
FIG. 7 is a flow chart of an exemplary embodiment of the present invention.

Referring to FIG. 7, a method of using the present invention may include the following. The teaching device 10 disclosed above may be provided. A teacher, coach, instructor, student or the like would understand that the target line pointer 14 represents the target line, that the shooter number pointer 16 represents the break line where the students will try to break the clay target, that the actual number pointer 18 represents the place where the clay target was actually broken, that the target holder 22 represents the clay target, and that the sequential numbers may represent a portion of a 360 degree directional orientation system. In certain embodiments, the sequential numbers may represent for a flight path of clay target. As the plurality of pointers 26 are rotatable by the user, they allow the student to represent a plurality of choices and outcomes along the 360 degree directional orientation system of the clock face 12.

In step 40, the user can determined the target path or line, and physically represent said target path by positioning the target line pointer 14 at a predetermined "time" represented by the sequential numbers.

In step 50, the user can predict and/or choose a break line that would allow the clay target to be hit, and physically represent said break line by positioning the shooter number pointer 16 at a predetermined "time" represented by the sequential numbers.

In step 60, the shooter shoots their optically aimed weapon.

In step 70, the user can move the actual number pointer 18 to the "time" represented by the sequential numbers so as show where the clay target actually was hit.

As a result, the teaching device 10 allows students to make comparisons between where they thought the clay target would break and where the break actually occurred. This allows the student to self-correct for the next clay target. The coach or shooting student would use the teaching device 10 as a more efficient way to choose the best place to shoot the clay target, wherein the teaching device 10 greatly simplifies the decision-making process and increases the student's awareness of target lines, break lines and accuracy of their predictions, by making the conceptual aspects thereof tangible.

It should be understood, of course, that the foregoing relates to exemplary embodiments of the invention and that modifications may be made without departing from the spirit and scope of the invention as set forth in the following claims.

What is claimed is:

1. A teaching device for training shooters to choose the best place to shoot a clay target, comprising:

a clock face forming a centrally disposed pivot opening;

a plurality of pointers, each forming a pointer pivot opening;

a pivot fastener adapted to be received by the plurality of pivot openings so that the plurality of pointers are rotatably connected to the clock face about the pivot fastener; and a target holder centrally disposed on the pivot fastener.

2. The teaching device of claim 1, wherein the pivot fastener forms the target holder as its head.

3. The teaching device of claim 2, wherein the pivot fastener forms a plurality of deformable legs perpendicularly extending from the target holder and through the plurality of pivot openings.

4. The teaching device of claim 1, further comprising an adhesive securing the plurality of deformable legs to a back face of the clock face.

5. The teaching device of claim 1, further comprising a plurality of sequential numbers along and inward from a periphery of the clock face.

6. The teaching device of claim 1, wherein each pointer pivot opening is generally centrally disposed within its respective pointer.

7. A teaching device for training shooters to choose the best place to shoot a clay target, comprising:

a clock face forming a centrally disposed pivot opening;

a plurality of pointers, each forming a pointer pivot opening, wherein each pointer pivot opening is generally centrally disposed within its respective pointer;

a pivot fastener adapted to be received by the plurality of pivot openings so that the plurality of pointers are rotatably connected to the clock face about the pivot fastener, wherein the pivot holder comprises:

a target holder formed on the pivot fastener; and a plurality of deformable legs perpendicularly extending from the target holder and through the plurality of pivot openings;

an adhesive securing the plurality of deformable legs to a back face of the clock face; and a plurality of sequential numbers along and inward from a periphery of the clock face.

* * * * *